US006163990A

United States Patent [19]

Urata et al.

[11] Patent Number: 6,163,990

[45] Date of Patent: Dec. 26, 2000

[54] STEAM IRON WITH SCALE DEPOSIT REPRESSION

[75] Inventors: Takayuki Urata, Kawabe-gun; Kunihiro Tsuruta, Kashihara; Naruaki Akai, Yamatokoriyama; Shuzo Tokumitsu, Kawanishi; Yasuharu Otsuka, Soraku-gun; Takahisa Tsuji, Takatsuki, all of Japan

[73] Assignee: Matsushita Electric Industrial Co., Ltd., Japan

[21] Appl. No.: 09/170,109

[22] Filed: Oct. 13, 1998

[30] Foreign Application Priority Data

| | | | |
|---|---|---|---|
| Oct. 13, 1997 | [JP] | Japan | 9-278403 |
| Aug. 4, 1998 | [JP] | Japan | 10-220046 |
| Sep. 16, 1998 | [JP] | Japan | 10-261164 |

[51] Int. Cl.[7] ..... D06F 75/18

[52] U.S. Cl. ..... 38/77.8

[58] Field of Search ..... 38/77.8, 77.83, 38/77.3, 77.6; 422/13; 210/699; 219/245; 423/321.1, 321.2, 314, 315

[56] References Cited

U.S. PATENT DOCUMENTS

| | | | |
|---|---|---|---|
| 4,756,881 | 7/1988 | Hoots et al. | 422/13 |
| 4,969,393 | 11/1990 | Mahlick et al. | 38/77.8 |
| 5,256,303 | 10/1993 | Zeiher et al. | 210/699 |
| 5,507,108 | 4/1996 | Bruggink et al. | 38/77.8 |

FOREIGN PATENT DOCUMENTS

| | | | |
|---|---|---|---|
| 089256 | 9/1983 | European Pat. Off. . | |
| 489714 | 6/1992 | European Pat. Off. | 38/77.3 |
| 554549 | 8/1993 | European Pat. Off. | 38/77.83 |
| 2632331 | 12/1989 | France | 38/77.6 |
| 2653455 | 4/1991 | France . | |
| 59-35640 | 8/1984 | Japan . | |
| 61-179194 | 8/1986 | Japan . | |
| 6-254299 | 9/1994 | Japan . | |

*Primary Examiner*—Ismael Izaguirre
*Attorney, Agent, or Firm*—Parkhurst & Wendel, L.L.P.

[57] ABSTRACT

A steam iron of the present invention is aimed at spraying a stable steam by repressing deposit of scale when producing the steam, and at reducing the scale that adheres to clothes by miniaturizing the scale particles. The steam iron includes a scale deposit repressing device for repressing the deposit of scale by dissolving phosphatic compound into water in a water tank that stores the water for supply to a vaporization chamber.

12 Claims, 4 Drawing Sheets

STEAM IRON WITH SCALE DEPOSIT REPRESSION

BACKGROUND OF THE INVENTION

1. Field of the Invention

The present invention relates to steam irons for flattening wrinkles, etc., of clothes by providing moisture.

2. Description of the Prior Art

Steam irons are used with tap water in general. However, since tap water contains inorganic substances such as calcium and sodium, they remain within a steam iron as evaporation residue after the water is evaporated inside a vaporization chamber if untreated tap water is used, and they gradually accumulate as the scale within the vaporization chamber and a steam passageway from the vaporization chamber to a steam nozzle. If the iron is used for a long time, narrow portions of the steam passageway are eventually clogged and spray of steam is obstructed. Some countermeasures are devised in order to avoid adverse effects this kind due to the scale.

A first example is a means to use an ion exchange resin in order to reduce deposit of the scale by turning water into soft water or demineralized water, as disclosed in the Japanese Patent Examined Publication No. S59-35640.

A second example is to place an inhibitor, a chelating agent, etc. in a water tank and dissolve them into water inside the water tank so as to discharge the scale outside of the steam iron with a flow of steam, as the scale decreases its mechanical strength and becomes less liable to adhere due to an effect of the inhibitor or the chelating agent dissolved in the water, as disclosed in the Japanese Patent Laid-Open Publication No. S61-179194.

A third example is to dissolve phosphonate compound into water in the water tank so as to reduce deposit of the scale by an effect of the phosphonate compound dissolved in the water, as disclosed in the Japanese Patent Laid-Open Publication No. H06-254299.

However, the first example is not suitable for ordinary households because it is difficult to manage for maintaining the water quality properly as a time period in which the ion exchange resin can keep the original efficiency is short.

Also, the second and the third examples have a problem in that particles of the scale which are discharged outside of the iron with the steam are so large that they tend to stick to clothes being ironed and are conspicuous.

DISCLOSURE OF THE INVENTION

A first object of the invention is to spray stable steam by reducing deposit of scale and to reduce the scale particles that stick to clothes by making them into very fine particles. A second object is to maintain an effect of reducing deposit of the scale to last for a long period of time. And a third object is to use phosphatic compounds effectively. Other objects will become apparent as exemplary embodiments are described hereinafter.

In order to achieve the first object stated above, the present invention is to provide a water tank for holding water to be supplied to a vaporization chamber, and to reduce deposit of scale by having a phosphatic compound in the water within the water tank.

In this way, the scale is turned into very fine particles of crystal, and to increase a dispersibility of the scale particles so as to maintain an effectiveness of reducing deposit of the scale for a long time with dissolution of only a small amount of the phosphatic compound. The large dispersibility of scale particles enables the iron to spray a stable steam without causing the vaporization chamber and the steam passageway to clog, and to make the scale less liable to adhere with clothes and hence inconspicuous since the particles are very small.

In order to achieve the second object, the present invention is to provide with a scale deposit repression means for repressing deposit of the scale by dissolving phosphatic compound in the water inside the water tank. The scale deposit repression means, which is placed inside the water tank, comprises a water permeable container containing phosphatic compound.

In this manner, the scale deposit repression means is easily placed inside the water tank, and an effect of reducing deposit of the scale can be maintained for a long period of time since the phosphatic compound is contained inside the water permeable container that gradually discharges water dissolved with phosphatic compound to the water tank.

Also, in order to achieve the third object, the present invention is to place the scale deposit repression means in the manner that the phosphatic compound is lifted out of the water surface when the iron is in a resting position while the water tank is filled with a predetermined amount of water.

This will prevent the phosphatic compound from dissolving in the water inside the water tank when the iron is at a short rest during ironing or when the iron is put away for storage, etc., so as to be able to utilize the phosphatic compound efficiently.

DETAILED DESCRIPTION OF THE INVENTION

A first mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, and it is capable of making the scale into very fine particles of crystal so as to increase dispersibility of the scale particles, thereby repressing deposit of the scale for a long period of time with dissolution of a small amount of the phosphatic compound, spraying a stable steam and reducing an amount of the scale that adheres to clothes.

In general, the scale that deposits inside the vaporization chamber and a steam passageway in the steam iron is the residue of inorganic substances such as calcium and sodium contained in water after the water evaporates. Since calcium carbonate, etc., in particular have very small solubilities to water, the residue, once produced, will scarcely dissolve in the water that drips successively into the vaporization chamber for turning into steam, so as to result in a large mass of crystal due to consecutive accumulation of the residue. In consequence, the scale locally accumulated inside the vaporization chamber will block the steam passageway, etc., to obstruct a stable spray of the steam.

As the means for repressing the deposit of scale, phosphatic compound gets into crystal being produced when the inorganic substances contained in the water deposit during vaporization. If phosphor, that is a foreign component, gets into a crystal of a uniform component, a structure of the crystal distorts, thereby being unable to grow larger. Consequently, the scale is produced into fine particles and some of them are discharged outside with the steam as they disperse inside the vaporization chamber. Therefore, the steam iron represses the scale deposit inside the vaporization chamber, and is able to spray steam steadily for a long period of time without suffering a clog of the steam passageway.

Figure 8:
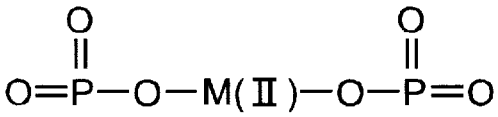
FIG. 8 is a chemical formula of meta-phosphate used as a scale deposit repression means of a steam iron of the present invention.
Figure 9:
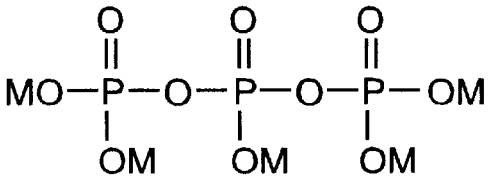
FIG. 9 is a chemical formula of tripoly-phosphate used as a scale deposit repression means of the steam iron of the present invention.
Figure 10:
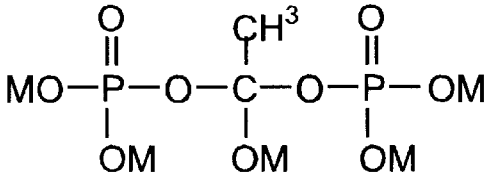
FIG. 10 is a chemical formula of phosphonate used in the prior art.

Some of the phosphatic compounds such as meta-phosphate, tripoly-phosphate, etc. contain higher ratios of phosphorus in each molecules as compared with phosphonate compound, as shown by chemical formulae in FIG. 8 (for meta-phosphate), FIG. 9 (for tripoly-phosphate) and FIG. 10 (for phosphonate). For this reason, the phosphatic compounds have higher efficiencies for miniaturizing crystals of the scale and for dispersing the scale inside the vaporization chamber as compared to the phosphonate, they can maintain spray of steady steam for a long period of time and make the scale inconspicuous as the discharged scale particles are so small in size.

A second mode of a steam iron of the present invention adopts meta-phosphate for the phosphatic compound in the steam iron of the first mode. The meta-phosphate produces a substantially higher effect of repressing the scale deposit among the phosphatic compounds, since the meta-phosphate contains two phosphorus atoms in each of its molecules, and the two atoms bond with calcium, etc. from both sides within the scale.

A third mode of a steam iron of the present invention adopts meta-phosphate having divalent cation for the phosphatic compound in the steam iron of the first mode. Since the meta-phosphate of divalent cation causes the scale particles to disperse throughout the sole plate of the iron as it keeps the solubility at a low level, it is able to maintain performance of the steady steam without clogging the steam passageway due to local accumulations, and to suppress adhesion of the scale particles to clothes so as to make the scale inconspicuous by reducing the scale particles discharged.

A fourth mode of a steam iron of the present invention adopts a mixture of meta-phosphate having divalent cation and phosphate having monovalent cation for the phosphatic compound in the steam iron of the first mode. A solubility of the meta-phosphate can be thus adjusted by mixing the meta-phosphate containing divalent cation and phosphate containing monovalent cation. Accordingly, when a ratio of the monovalent cation is increased, the solubility, and hence a scale clastic effect also increase so as to increase an amount of the scale particles discharged. In the end, an effect of repressing the scale deposit within the steam iron can further increase, and spray of the steady steam is maintained for a longer period of time, since the scale particles are finely miniaturized so as to be inconspicuous and to be easily discharged to the outside, even if the amount of the scale discharged is increased.

A fifth mode of a steam iron of the present invention adopts a mixture of calcium meta-phosphate and potassium salt of phosphoric acid for the phosphatic compound in the steam iron of the first mode, in order to repress the scale deposit and to miniaturize the scale particles to be discharged.

A sixth mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, wherein the scale deposit repression means comprising a water permeable container for encapsulating the phosphatic compound is placed inside the water tank, so that it is capable of maintaining an effect of repressing the scale deposit for a long period of time, since the water dissolved with the phosphatic compound inside the water permeable container is gradually discharged into the water tank because the scale deposit repression means is easily placed inside the water tank and the phosphatic compound is encapsulated within the water permeable container.

A seventh mode of a steam iron of the present invention comprises the scale deposit repression means having the phosphatic compound in a form of solid or pellet or granule in one of the steam irons of the first through the sixth modes so as to facilitate encapsulation of the phosphatic compound inside the water permeable container for an expediency of use.

An eighth mode of a steam iron of the present invention comprises the scale deposit repression means having the phosphatic compound encapsulated to be freely movable within the water permeable container in one of the steam irons of the sixth and the seventh modes, so as to effectively dissolve the phosphatic compound in the water inside the water permeable container with movement of the phosphatic compound within the water permeable container, and to discharge the water dissolved with the phosphatic compound inside the water permeable container to the water tank with the movement of the phosphatic compound for supply to the vaporization chamber.

A ninth mode of a steam iron of the present invention comprises the scale deposit repression means having a sealing net for encapsulating the phosphatic compound inside the water permeable container in one of the steam irons of the sixth through the eighth modes, and the sealing net is attached by placing it on a side facing toward a bottom surface of the water tank, so as to simply compose a scale bond prevention device by sealing the phosphatic compound housed inside the water permeable container with the sealing net, and to repress the scale deposit by the dissolved phosphatic compound by way of fluidized replacement of the water within the water tank with water in the water permeable container through the sealing net.

A tenth mode of a steam iron of the present invention comprises the scale deposit repression means which supports the water permeable container with a plurality of structural members composing the water tank in one of the steam irons of the sixth through the ninth modes, so as to be able to fix the water permeable container within the water tank by a simple structure.

An eleventh mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, wherein the scale deposit repression means is placed in a manner that it is lifted out of the water surface when the iron is in a resting position while the water tank is filled with a predetermined amount of water so as to prevent the phosphatic compound from dissolving in the water inside the water tank when the iron is at rest, etc. for making an efficient use of the phosphatic compound.

DESCRIPTION OF THE PREFERRED EMBODIMENTS

Preferred embodiments of the present inventions will be described hereinafter by referring to figures.

First Exemplary Embodiment

Figure 1:
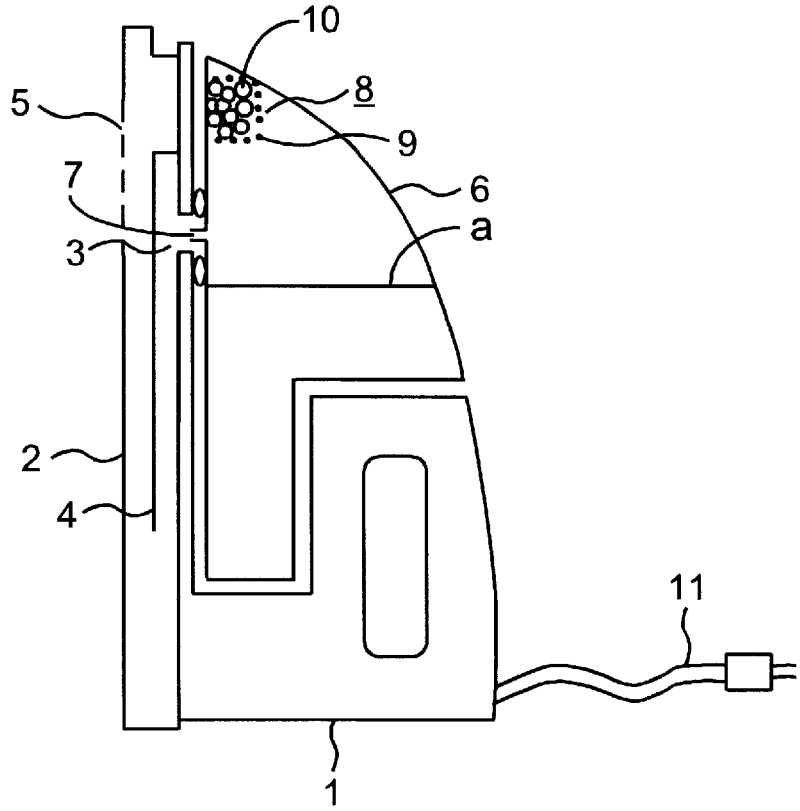
FIG. 1 is a cross-sectional view of an essential part of a steam iron of a first exemplary embodiment of the present invention, while in a resting position.
Figure 2:
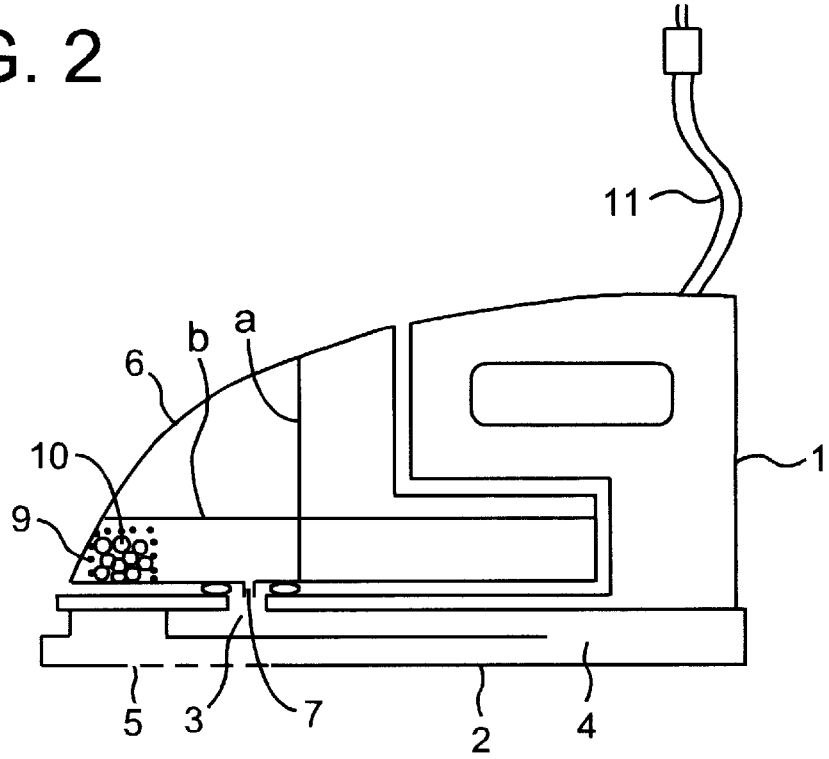
FIG. 2 is a cross-sectional view of an essential part of the steam iron of the first exemplary embodiment, while in an ironing position.

As shown in FIG. 1 and FIG. 2, numeral 1 represents a main body of a steam iron (hereinafter referred to as the main body), equipped with a sole plate 2 which is heated by heating means such as a heater. Numeral 3 represents a vaporization chamber provided on the sole plate 2 for evaporating water, and steam generated by the vaporization chamber 3 is discharged to the outside from a steam nozzle 5 after passing through a steam passageway 4. Numeral 6 represents a water tank for storing water to be supplied to the vaporization chamber 3, and it is removably attached to the main body 1. Numeral 7 is a drip hole of water provided in a bottom portion of the water tank 6 for dripping the water into the vaporization chamber 3. Numeral 8 is a scale deposit repression means provided within the water tank 6, comprising a water permeable container 9 encapsulating phosphatic compound 10, and the water inside of the water tank 6 can move freely between an inside and an outside of the water permeable container 9. Numeral 11 is a power supply cord for supplying electrical power to the main body 1. The scale deposit repression means 8 encapsulates the phosphatic compound 10 such as calcium meta-phosphate, etc. in a form of solid, pellets or granulated particles inside of the water permeable container 9 for repressing deposit of scale by dissolving it into the water inside the water tank 6.

The following is to describe an operation of the present embodiment. When a worker carries out ironing, first, he pours an amount of water into the water tank 6 to an extent not to exceed a predetermined amount and attach it to the main body 1, places the iron on a heel-rest for a standby position as depicted in FIG. 1, turns the power on, and sets for a specific temperature. The iron will be ready to use when it reaches the set temperature in due course.

When the main body 1 of the iron is moved to a position for ironing as depicted in FIG. 2, the water inside the water tank 6 shifts a water level a of the standby position to a water level b, so that the water permeable container 9 and the phosphatic compound 10 submerge under the water. The phosphatic compound 10 begins to dissolve into the water at this time and diffuses throughout the water inside the water tank 6. The water dripped through the drip hole 7 into the vaporization chamber 3 evaporates instantly. Steam generated in the vaporization chamber 3 is discharged from the steam nozzle 5 toward outside of the sole plate 2 after passing through a steam passageway 4.

An effect of the phosphatic compound is now described using an experimental example. In this example, water of the normal hardness was prepared by dissolving 0.22 g of calcium chloride (di-hydrate), 0.062 g of magnesium sulphate and 0.2233 g of sodium hydrogencarbonate, each per liter ion-exchanged water, so as to adjust the water hardness to be 200 ppm.

Steam irons used for the experiment were one in which the phosphatic compound 10 is removed (hereinafter referred to as a blank sample), another one in which granulated product of calcium phosphonate is used in place of the phosphatic compound 10 (hereinafter referred to as a phosphonate sample), another one in which granulated product of tripoly-phosphate is used for the phosphatic compound 10 (hereinafter referred to as a tripoly-phosphate sample), another one in which granulated product of calcium meta-phosphate is used for the phosphatic compound 10 (hereinafter referred to as a calcium meta-phosphate sample), and still another one in which granulated product in a composite state of calcium meta-phosphate mixed with a small amount of potassium meta-phosphate as weighed against the calcium meta-phosphate is used for the phosphatic compound 10 (hereinafter referred to as a meta-phosphate mixture sample).

Figure 3:
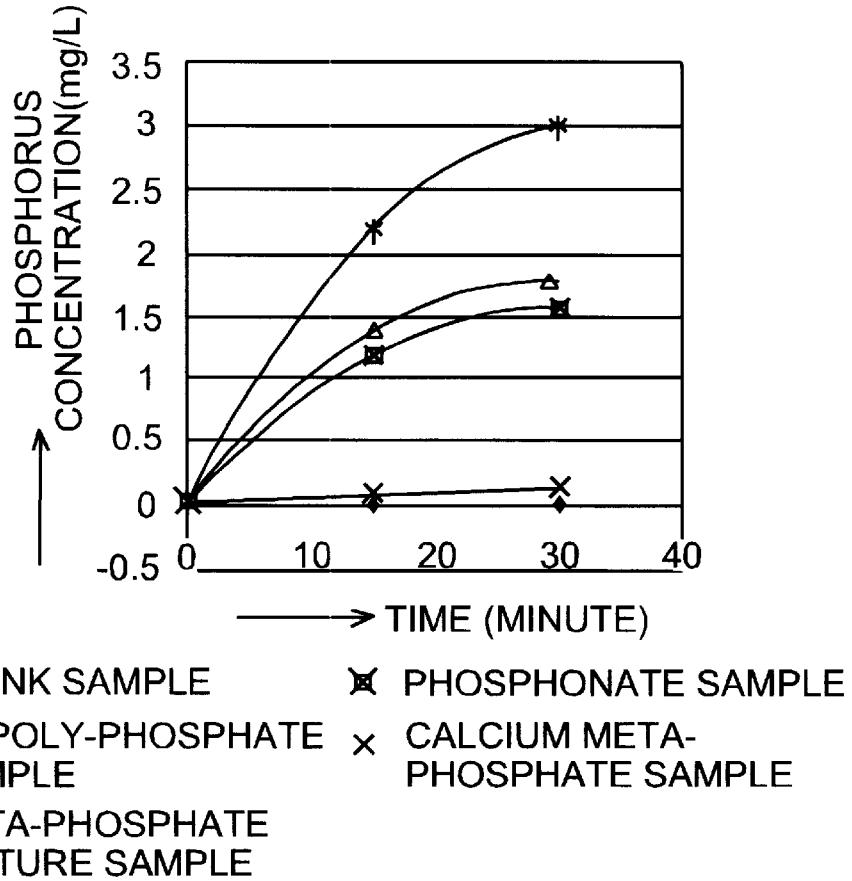
FIG. 3 is a graphic chart showing concentrations of dissolved phosphor.

Water tanks 6 in each steam iron samples were filled with a 100 milliliter water of the normal hardness, and ironing was carried out in the ordinary manner. In this ironing test, an initial amount of discharged steam was 3.3 g/min for all samples so that the water in the water tank 6 was consumed in about 30 minutes. Concentrations of dissolved phosphor in the water of normal hardness during this test are shown in FIG. 3. As a result, the blank sample did not show any dissolution of phosphor, but the phosphonate sample, the tripoly-phosphate sample and the meta-phosphate mixture sample exceeded a concentration of 1 mg/l within 15 minutes. The calcium meta-phosphate sample showed a concentration of 0.12 mg/l after 30 minutes, and it never exceeded 1 mg/l. A result of the experiment during an 80th cycle of the repeated ironing is shown in Table 1 below.

TABLE 1

| Sample | Amount of Steam (g/m) | Visual Observation of Discharged Scale |
|---|---|---|
| Blank sample | 0.1 | Slightly conspicuous |
| Phosphonate sample | 2 | Substantially conspicuous |
| Tripoly-phosphate sample | 2 | Scarcely conspicuous |
| Calcium meta-phosphate sample | 2 | Hardly conspicuous |
| Meta-phosphate mixture sample | 3 | Scarcely conspicuous |

In the experiment, the visual observation of discharged scale was carried out by three persons who visually observed scale particles deposited on clothes after they were ironed, and the clothes were rated in five grades, i.e. "substantially conspicuous", "medially conspicuous", "slightly conspicuous", "scarcely conspicuous", and "hardly conspicuous" in an order of conspicuousness of the scale particles. The blank sample had barely sprayed steam at the 80th cycle, whereas the other samples had still sprayed steam well showing they all had effects of sustaining a duration of the steaming.

Among those, the meta-phosphate mixture sample had kept the nearly same amount of steam as the initial amount. Pertaining to the conspicuousness of the discharged scale particles, the phosphonate sample was more conspicuous than the blank sample. But the discharged scale particles from the tripoly-phosphate sample, the calcium meta-phosphate sample and the meta-phosphate mixture sample were less conspicuous than the blank sample.

An examination was also carried out for the scale that had adhered on the vaporization chamber 3, the steam passageway 4 and the steam nozzle 5 by having disassembled the steam irons used for the tests. In the blank sample, scale had been accumulated in a vicinity of the drip hole 7 more solidly within the vaporization chamber 3 to nearly block the drip hole 7. In the phosphonate sample, the scale had adhered in a small fragmental shape around walls of the vaporization chamber 3 and the steam passageway 4, and partly extending near to the steam nozzle 5. Inside the tripoly-phosphate sample, scale particles in a size smaller than those of the phosphonate sample had spread in nearly the same condition as the phosphonate sample. Scale particles of the calcium meta-phosphate sample and the meta-phosphate mixture sample were both in a form of fine crystals. While the scale particles in the calcium meta-phosphate sample had spread nearly the same condition as the phosphonate sample and the tripoly-phosphate sample, the meta-phosphate mixture sample showed spreading in a uniform condition from the vaporization chamber 3 to the steam passageway 4, and further toward the steam nozzle 5.

A reason for noted difference this is that the scale particles in the phosphonate sample become smaller than those of the blank sample because the phosphonate has an effect of miniaturizing the scale particles, they spread and do not block the drip hole 7 during the 80 cycles of ironing, so as to prolong the duration of steaming. However, the discharged scale becomes more conspicuous than the blank sample since the smaller and spread scale particles are more easily dischargeable from the steam nozzle 5.

The phosphatic compound has a greater effect of miniaturizing the scale particles than the phosphonate. Because the tripoly-phosphate makes the scale particles even smaller as compared to the phosphonate, the discharge scales are small enough to be less conspicuous in contrast to the phosphonate sample and even to the blank sample, although an approximately same amount of the scale as the phosphonate sample is estimated to be discharged. The calcium tripoly-phosphate and the mixture of calcium meta-phosphate and potassium meta-phosphate have an even greater effect of miniaturizing the scale particles. When a concentration of phosphorus dissolved in the water is kept at a low density (1 mg/l or less in this test) by using meta-phosphate like the calcium meta-phosphate sample, the scale is crystallized into fine particles, and a condition of the dispersion within the iron becomes similar to those of the phosphonate sample and the tripoly-phosphate sample. Therefore, the scales became scarcely conspicuous in the visual examination since the particles are extremely small, even if approximately same amount of the scale is discharged as the phosphonate sample and the tripoly-phosphate sample.

When a concentration of phosphorus dissolved in the water is increased (1 mg/l or more in this test) by using the meta-phosphate like the meta-phosphate mixture sample, the scale is crystallized into fine particles and the scale particles generated within the vaporization chamber 3 result in a high effect of dispersion, they disperse nearly uniformly throughout the vaporization chamber 3, the steam passageway 4 and the steam nozzle 5 in the iron, and a greater amount of the scale is discharged to the outside than the phosphonate sample, the tripoly-phosphate sample and the calcium meta-phosphate sample. For this reason, an amount of the scale that remains within the steam iron is very small so as to be able to maintain an amount of the steam at almost equal to the initial level. Besides, the scale is scarcely conspicuous in the visual examination since the particles are extremely small, even though the scale of substantial amount is discharged. In the test, the potassium meta-phosphate was adjusted to be within 0.5 to 10% as weighed against the calcium meta-phosphate. Hence, the present embodiment is able to make a prolongation of the steam to be consistent with a dissolving duration of the meta-phosphatic compound by adjusting a mixing ratio as recited above.

The present embodiment disposes the phosphatic compound 10 in a manner that it locates above the water surface in the water tank 6 when the iron is in a resting position. Therefore, the phosphatic compound 10 can be used efficiently as it does not contact with the water within the water tank 6 to needlessly dissolve, even when the iron is at rest or left out for a moment, or when it is stored without draining the water tank 6.

Next, a manufacturing method of the phosphatic compound 10 and a granulated product of the present invention will be described. Calcium dihydrogen-phosphate is used as a raw material of the calcium meta-phosphate in the present embodiment.

First, the material is thoroughly mixed with water. During this process, an inorganic substance such as methylcellulose or an organic substance such as water glass may be used as a binder instead of the water. After the thorough mixing, the material is granulated by an extrusion granulator, and is calcined at 250° C. or a higher temperature. The calcination temperature was 800° C. in case of the present embodiment.

Chemical reaction during this calcination produces calcium meta-phosphate. Or, it can be granulated using a binder in a form of suspension dispersed with ethylcellulose, acrylic resin, etc., after having produced powder of the calcium meta-phosphate. It is also possible to produce calcium meta-phosphate using any raw materials containing phosphatic base and calcium, other than calcium dihydrogen-phosphate.

Because solubility with water of calcium meta-phosphate is very small, an infinitesimal amount of meta-phosphate can be added into water by selecting an appropriate diameter for the granules. In the present embodiment, calcium meta-phosphate granules having a diameter of approximately 3 mm were produced.

In order to produce the composite compound of calcium meta-phosphate and potassium meta-phosphate, a compound of phosphatic acid and calcium such as calcium dihydrogen-phosphate and a compound of phosphatic acid and potassium such as potassium hexameta-phosphate are mixed well, and calcined at 250° C. or a higher temperature after it is granulated using water or any other appropriate binder. A calcination temperature selected in the present embodiment was 800° C.

The solubility of potassium meta-phosphate is greater than that of calcium meta-phosphate. Therefore, potassium meta-phosphate alone will soon be dissolved in water and consumed. Since the composite compound of calcium meta-phosphate and potassium meta-phosphate as used in the present embodiment, which can be produced by granulating and calcining the mixture of a compound of phosphatic acid and calcium such as calcium dihydrogen-phosphate and a compound of phosphatic acid and potassium such as potassium hexameta-phosphate, disperses calcium portions and potassium portions with each other, so that both the potassium portions and the calcium portions dissolve alternately rather than first dissolving only the potassium portions, thereby obtaining a substance having a greater solubility of phosphor than solitary of calcium meta-phosphate as the result.

In this way, a compound of a desirable solubility is producible by selecting a mixing ratio between calcium and potassium.

A user is able to use a steam iron easily in the same manner as a conventional iron without needing a peculiar manipulation, with the steam iron furnished with the granulated compound in advance within the water tank 6 as shown in FIG. 1.

Solubility is also adjustable with a surface area of the phosphatic compound 10 by selecting the compound in a form of solid, pellet or granule, and this selection can simplify a structure of the water permeable container 9 at the same time. When powdery compound is used, the water permeable container 9 needs to include a fine mesh sieve or a similar unwoven cloth. If the water permeable container 9 is of fine sieve material, not only does the solubility of the phosphatic compound 10 deteriorate due to an impediment of water passage but also does it tend to clog with small dusts, etc. By using the granulated compound, however, a screen net or a slit having a mesh of slightly smaller than the granules can be employed so as to provide with an expediency by good water passage and practically no probability of clogging with dusts, etc.

Second Exemplary Embodiment

Figure 4:
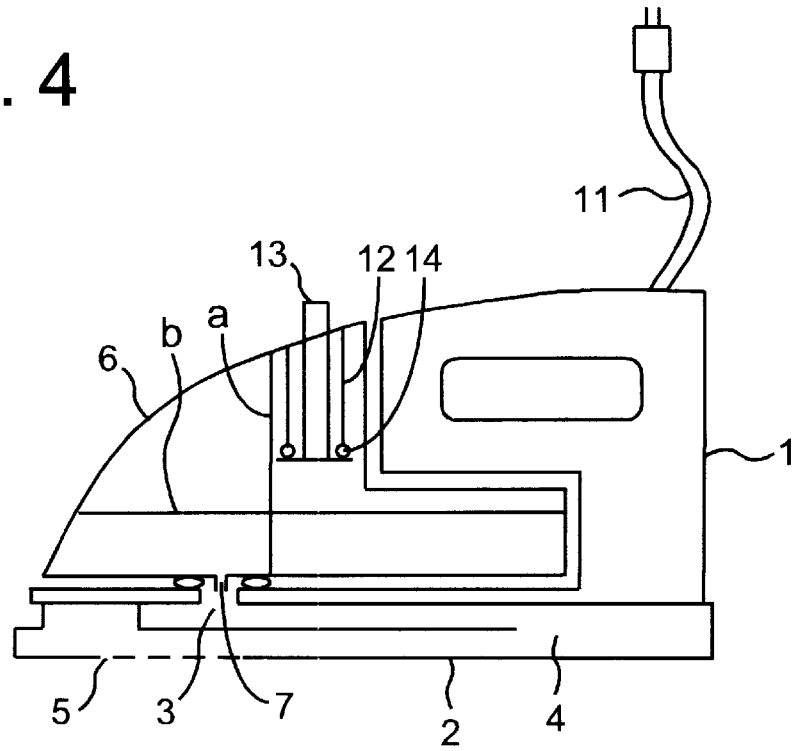
FIG. 4 is a cross-sectional view of an essential part of a steam iron of a second exemplary embodiment of the present invention.

FIG. 4 shows a steam iron adapted to be capable of adding liquid of phosphatic compound into water inside of a water tank. Numeral 12 is a container disposed in the water tank 6 for storing liquid of the phosphatic compound. Numeral 13 is a cylinder and numeral 14 is an opening valve. Liquid of the phosphatic compound stored in the container 12 can be added into the water in the water tank 6 by pushing the cylinder 13 which releases the opening valve 14 from the container 12.

An experiment was performed using samples in the steam iron shown in FIG. 4, of which the container 12 were filled with solution of sodium meta-phosphate, and one sample was adjusted by adding an amount of the solution into the water in the water tank 6 so as to produce a phosphorus concentration of 0.1 mg/l by one push of the cylinder 13 (hereinafter referred to as a 0.1 liquid sample), and the other sample was adjusted in the same way but to produce a phosphorus concentration of 2.5 mg/l (hereinafter referred to as a 2.5 liquid sample).

The water tanks 6 in each iron samples were filled with 100 milliliter water of the normal hardness, and each of the cylinders 13 was pushed once. Ironing was then carried out in the ordinary manner. In this ironing test, an initial amount of discharged steam was 3.3 g/min for both samples so that the water in the water tanks 6 was consumed in about 30 minutes. A result of the experiment during an 80th cycle of the repeated ironing is shown in Table 2 below.

TABLE 2

| Sample | Amount of Steam (g/m) | Visual Observation of Discharged Scale |
|---|---|---|
| 0.1 liquid sample | 2 | Hardly conspicuous |
| 2.5 liquid sample | 3 | Scarcely conspicuous |

As indicated, the steam iron samples using liquid of the phosphatic compound can produce the similar effect as the calcium meta-phosphate sample and the meta-phosphate mixture sample using granulated phosphatic compound.

Third Exemplary Embodiment

Figure 5:
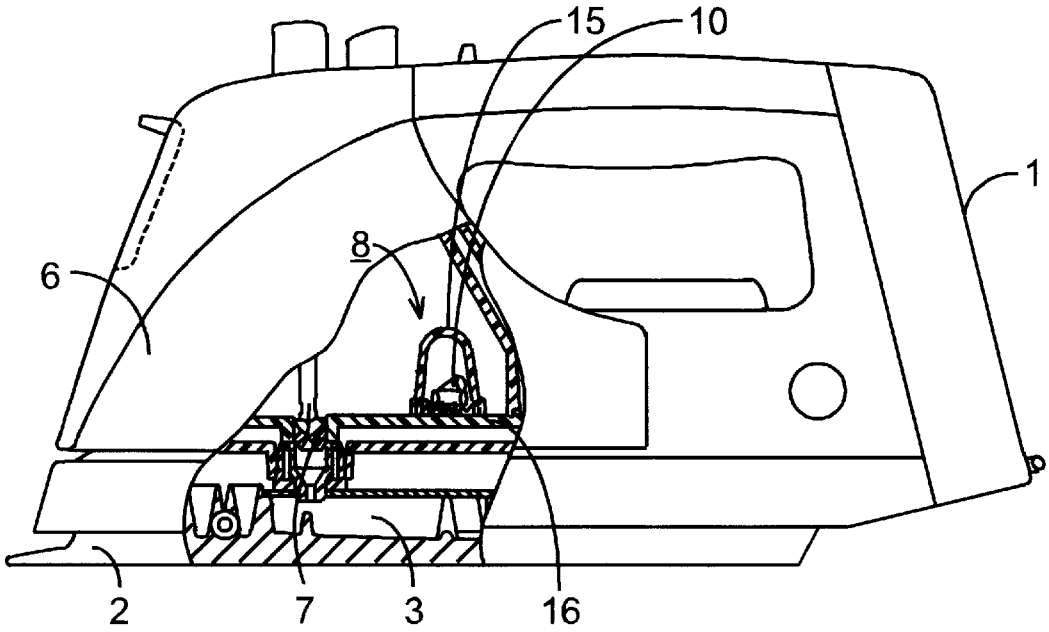
FIG. 5 is a cross-sectional view of an essential part of a steam iron of a third exemplary embodiment of the present invention.
Figure 6:
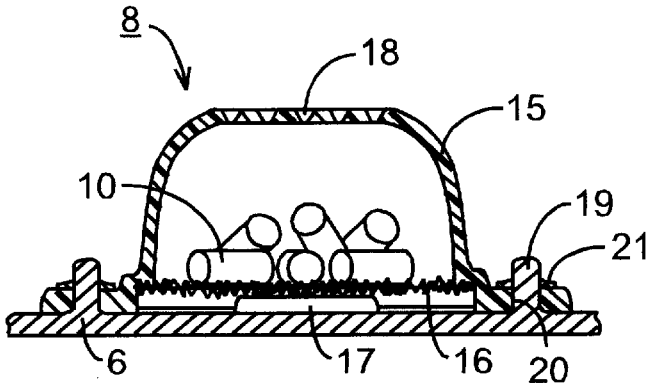
FIG. 6 is an enlarged cross-sectional view of a scale deposit repression means of the steam iron of the third exemplary embodiment.

FIG. 5 and FIG. 6 show a concrete example of a water permeable container 15 for storing phosphatic compound 10, wherein the water permeable container 15 is made of molded synthetic plastic forming a space large enough to store a predetermined amount of phosphatic compound 10, and the phosphatic compound 10 is placed to be easily movable within the water permeable container 15. The water permeable container 15 is sealed by a sealing net 16 with the phosphatic compound 10 placed inside. The water permeable container 15 has an opening 17 at a bottom part of it for allowing water to permeate, and a small hole 18 at a top part of it for bleeding air as well as for allowing the water to permeate and escape, and it is fixed to a bottom of a water tank 6 by fitting a protrusion 19 provided on the bottom the water tank 6 into a mounting hole 20 and fastening a push nut 21 from above.

With the structure as described above, the water inside the water tank 6 permeates into the water permeable container 15 through the sealing net 16 from the opening 17 provided at the bottom part of the water permeable container 15, when the iron is postured in an ironing position. The water permeable container 15 is filled with the water as air or water standing in the water permeable container 15 escapes through the small hole 18 to the water tank 6, so that the phosphatic compound 10 dissolves gradually into the water inside the water permeable container 15. The water dissolved with the phosphatic compound 10 flows out of the water permeable container 15 through the sealing net 16 and the small hole 18 to replace the water in the water tank 6.

Accordingly, a scale deposit repression means 8 can be readily fixed in the water tank 6, and an effect of repressing the scale deposit can be maintained for a long period of time as the water dissolved with the phosphatic compound 10 inside the water permeable container 15 gradually flows out to the water tan 6 because the phosphatic compound 10 is stored inside of the water permeable container 15.

Also, since the scale deposit repression means 8 is constructed so that the phosphatic compound 10 is movable within the water permeable container 15, the water dissolved with the phosphatic compound 10 is progressively expelled to the outside of the water permeable container 15 by movements of the phosphatic compound 10 within the water permeable container 15 with an ironing motion, so as to be able to dissolve the phosphatic compound 10 quickly for repressing the scale deposit.

Fourth Exemplary Embodiment

Figure 7:
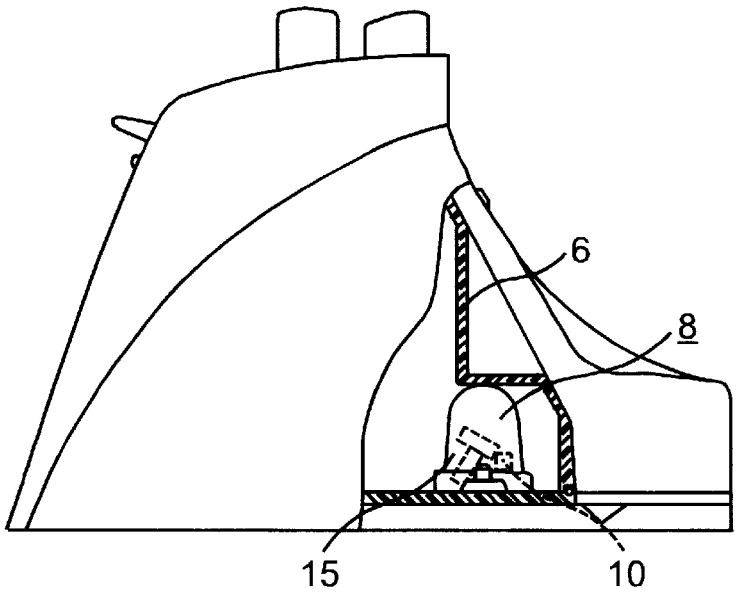
FIG. 7 is a cross-sectional view of an essential part of a water tank of a steam iron of a fourth exemplary embodiment of the present invention.

The scale deposit repression means 8 as shown in FIG. 7 comprises a water permeable container 15 storing phosphatic compound 10, disposed in a water tank 6 and held at its upper portion with a part of the water tank 6, so that a structure can be simplified by utilizing a plurality of structural members composing the water tank 6 for holding the water permeable container 15.

As has been described, a first mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, and it is capable of repressing the scale deposit for a long period of time, spraying a stable steam and reducing an amount of the scale that adheres to clothes.

A second mode of a steam iron of the present invention is able to provide with a substantially high effect for repressing the scale deposit since it adopts meta-phosphate for the phosphatic compound.

A third mode of a steam iron of the present invention is able to further miniaturize the discharged scale particles so as to make them inconspicuous since it uses meta-phosphate of divalent cation salt for the phosphatic compound.

A fourth mode of a steam iron of the present invention is able to adjust solubility of the meta-phosphate, increases further an effect of repressing the scale deposit, maintains a spray of steady steam for a longer period of time, and closely adjusts an inconspicuousness of the discharged scale, since it uses a mixture of meta-phosphate containing divalent cation and phosphate containing monovalent cation for the phosphatic compound.

A fifth mode of a steam iron of the present invention is able to spray a stable steam by repressing the scale deposit and to miniaturize the scale particles to be discharged, as it adopts a mixture of calcium meta-phosphate and potassium salt of phosphoric acid for the phosphatic compound.

A sixth mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, wherein the scale deposit repression means comprising a water permeable container for encapsulating the phosphatic compound is placed inside the water tank, so that it is able to dispose the scale deposit repression means easily in the water tank, and continuously maintain an effect of repressing the scale deposit for a long period of time, since the water dissolved with the phosphatic compound inside the water permeable container is gradually discharged into the water tank because the phosphatic compound is encapsulated within the water permeable container.

A seventh mode of a steam iron of the present invention comprises the scale deposit repression means having the phosphatic compound in a form of solid or pellet or granule, so as to facilitate placement of the water permeable container containing the phosphatic compound inside the water tank for an expediency of use.

An eighth mode of a steam iron of the present invention comprises the scale deposit repression means having the phosphatic compound to be freely movable within the water permeable container, so that the water dissolved with the phosphatic compound inside the water permeable container is progressively discharged to the outside of the water permeable container with an ironing motion, and the phosphatic compound is effectively and quickly dissolved into the water inside the water tank.

A ninth mode of a steam iron of the present invention comprises the scale deposit repression means having a sealing net for encapsulating the phosphatic compound inside the water permeable container, and the sealing net is attached by placing it on a side facing toward a bottom surface of the water tank, so as to seal the phosphatic compound inside the water permeable container while maintaining a water permeability and to facilitate dissolution of the phosphatic compound in the water within the water tank even if the water tank is filled with a small amount of water.

A tenth mode of a steam iron of the present invention comprises the scale deposit repression means supporting the water permeable container with a plurality of structural members composing the water tank, so as to be able to fix the water permeable container within the water tank with a simple structure.

An eleventh mode of a steam iron of the present invention comprises a sole plate heated by a heater, a vaporization chamber provided on the sole plate for evaporating water, a steam nozzle for spraying steam generated by the vaporization chamber, a water tank for storing water to be supplied to the vaporization chamber, and a scale deposit repression means for repressing deposit of scale by dissolving phosphatic compound in the water inside the water tank, wherein the scale deposit repression means is placed in a manner that it is lifted out of the water surface when the iron is in a resting position while the water tank is filled with a predetermined amount of water so as to prevent the phosphatic compound from contacting with the water for avoiding needlessly dissolving in the water inside the water tank when the iron is at rest or when the iron is put aside for storage etc., and to be able to use the phosphatic compound efficiently.

What is claimed is:

1. A steam iron comprising:

(a) a sole plate heated by a heater;

(b) a vaporization chamber provided on said sole plate for evaporating water;

(c) a steam nozzle for spraying steam generated by said vaporization chamber;

(d) a water tank for storing water to be supplied to said vaporization chamber; and (e) a scale deposit repression means for repressing deposit of scale by dissolving a meta-phosphate in the water inside said water tank, said scale deposit repression means including a meta-phosphate.

2. The steam iron according to claim 1, wherein said meta-phosphate is meta-phosphate of divalent cation.

3. The steam iron according to claim 1, wherein said meta-phosphate is a mixture of meta-phosphate of divalent cation and phosphate of monovalent cation.

4. The steam iron according to claim 1, wherein said meta-phosphate is a mixture of calcium meta-phosphate and potassium salt of phosphoric acid.

5. The steam iron according to claim 1, wherein said scale deposit repression means includes meta-phosphate in a form of solid or pellet or granule.

6. The steam iron according to claim 1, wherein said scale deposit repression means comprises a water permeable container placed inside said water tank for encapsulating said meta-phosphate.

7. The steam iron according to claim 6, wherein said scale deposit repression means comprises meta-phosphate to be freely movable within said water permeable container.

8. The steam iron according to claim 6, wherein said scale deposit repression means includes a sealing net for encapsulating meta-phosphate inside said water permeable container, and wherein said sealing net is attached to said water permeable container by placing it on a side facing toward a bottom surface of said water tank.

9. The steam iron according to claim 6, wherein said scale deposit repression means supports said water permeable container with a plurality of structural members composing said water tank.

10. A steam iron comprising:

(a) a sole plate heated by a heater;

(b) a vaporization chamber provided on said sole plate for evaporating water;

(c) a steam nozzle for spraying steam generated by said vaporization chamber;

(d) a water tank for storing water to be supplied to said vaporization chamber; and (e) a scale deposit repression means for repressing deposit of scale by dissolving phosphatic compound in the water inside said water tank, wherein said scale deposit repression means is placed in a manner that it is lifted out of a water surface when said steam iron is in a resting position with said water tank filled with a predetermined amount of water, said scale deposit repression means being located at the tip of said steam iron.

11. A steam iron comprising:

(a) a sole plate heated by a heater;

(b) a vaporization chamber provided on said sole plate for evaporating water;

(c) a steam nozzle for spraying steam generated by said vaporization chamber;

(d) a water tank for storing water to be supplied to said vaporization chamber; and (e) a scale deposit repression means for repressing deposit of scale by dissolving phosphatic compound in the water inside said water tank, wherein said scale deposit repression means comprises a water permeable container placed inside said water tank for encapsulating phosphatic compound, and said phosphatic compound is meta-phosphate.

12. A steam iron comprising:

(a) a sole plate heated by a heater;

(b) a vaporization chamber provided on said sole plate for evaporating water;

(c) a steam nozzle for spraying steam generated by said vaporization chamber;

(d) a water tank for storing water to be supplied to said vaporization chamber; and (e) a scale deposit repression means for repressing deposit of scale by dissolving phosphatic compound in the water inside said water tank, wherein said scale deposit repression means includes phosphatic compound in a form of solid or pellet or granule, said phosphatic compound being encapsulated for being movable within a water permeable container and disposed inside said water tank, and wherein said phosphatic compound is meta-phosphate.

* * * * *